US008893901B2

(12) United States Patent
Nagel

(10) Patent No.: US 8,893,901 B2
(45) Date of Patent: Nov. 25, 2014

(54) MERCHANDISE PUSHER TRAY WITH ADJUSTABLE SIDE BARRIERS

(71) Applicant: Thomas O. Nagel, Rockford, IL (US)

(72) Inventor: Thomas O. Nagel, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 14/204,744

(22) Filed: Mar. 11, 2014

(65) Prior Publication Data

US 2014/0190914 A1 Jul. 10, 2014

Related U.S. Application Data

(63) Continuation of application No. 13/288,058, filed on Nov. 3, 2011, now Pat. No. 8,720,702.

(51) Int. Cl.
*A47F 1/04* (2006.01)
*A47F 7/00* (2006.01)

(Continued)

(52) U.S. Cl.
CPC ... *A47F 1/04* (2013.01); *A47F 5/01* (2013.01); *A47F 5/08* (2013.01); *A47F 5/0056* (2013.01);

(Continued)

(58) Field of Classification Search
CPC ..... A47F 1/125; A47F 3/14; A47F 5/0838; A47F 5/0025; A47F 1/04; A47F 1/126; A47F 1/128; A47F 1/121; A47F 5/0056; A47F 3/147; A47F 1/12; A47F 5/13; A47F 5/0081; A47F 1/02; A47F 1/08; A47F 5/0093; A47F 5/103; A47F 5/005; A47F 5/08; A47F 5/0006; A47F 5/01; A47F 5/0876; A47F 5/0062; A47B 46/005; A47B 96/025; A47B 57/30; A47B 96/061; A47B 96/067; A47B 57/40; A47B 57/408; A47B 57/06; A47B 96/06; A47B 57/58; A47B 57/581; A47B 57/585; A47B 57/588; A47B 57/42; A47B 57/48; A47B 57/56; A47B 57/52; A47B 47/022; A47B 47/021; A47B 96/027; A47B 96/028; A47B 73/002; A47B 55/02
USPC ..... 211/59.2, 59.3, 184, 72, 126.1, 126.16, 211/193, 88.02, 86.01, 87.01, 181.1, 126.5, 211/133.5, 90.01, 126.15, 175; 248/236, 248/211, 238, 215, 214, 235, 241, 250, 200, 248/220.21, 220.22; 221/56, 198, 226, 279; 312/71, 72, 35; 108/61, 108
See application file for complete search history.

(56) References Cited

U.S. PATENT DOCUMENTS 5,012,936 A * 5/1991 Crum ..... 211/59.3
5,069,349 A * 12/1991 Wear et al. ..... 211/59.3

(Continued)

FOREIGN PATENT DOCUMENTS

JP H11155708 A 6/1999
WO WO 2011/035371 A1 3/2011

*Primary Examiner* — Jennifer E Novosad
(74) *Attorney, Agent, or Firm* — Reinhart Boerner Van Deuren P.C.

(57) ABSTRACT

A merchandise pusher tray is provided. The merchandise pusher tray includes a base structure. The base structure is configurable for bar or shelf mounting. The base structure includes a pair of load bearing members for supporting a floor of the base structure. The merchandise pusher tray also includes at least one divider mounted to and adjustable in a first direction relative to the base structure. The merchandise pusher tray also includes a pusher mounted to and movable in a second direction relative to the base structure. A locking arm is provided for locking the pusher in a locked position and automatically unlocking the pusher from the locked position upon the exertion of an actuation force against the locking arm.

14 Claims, 10 Drawing Sheets

(51) Int. Cl.

| | |
|---|---|
| ***A47F 5/00*** | (2006.01) |
| ***A47F 5/08*** | (2006.01) |
| ***A47B 43/00*** | (2006.01) |
| ***A47B 47/00*** | (2006.01) |
| ***A47B 57/00*** | (2006.01) |
| ***A47F 5/01*** | (2006.01) |
| ***A47B 96/02*** | (2006.01) |
| ***A47B 47/02*** | (2006.01) |
| ***A47B 55/02*** | (2006.01) |
| ***A47B 96/06*** | (2006.01) |
| ***A47F 1/12*** | (2006.01) |
| ***A47F 3/04*** | (2006.01) |
| ***A47B 57/42*** | (2006.01) |
| ***A47B 57/52*** | (2006.01) |

(52) U.S. Cl.

CPC ..... *A47B 96/027* (2013.01); *A47B 47/022* (2013.01); *A47B 55/02* (2013.01); *A47B 96/061* (2013.01); *A47B 96/067* (2013.01); *A47F 1/126* (2013.01); *A47F 3/0486* (2013.01); *A47B 57/42* (2013.01); *A47B 57/52* (2013.01); *A47F 1/125* (2013.01); *A47F 1/128* (2013.01)

USPC .... 211/59.3; 211/193; 211/87.01; 211/90.01; 211/184

(56) References Cited

U.S. PATENT DOCUMENTS

| | | | | | |
|---|---|---|---|---|---|
| 5,133,463 | A | * | 7/1992 | Merl | 211/190 |
| 5,205,524 | A | * | 4/1993 | Cohen | 248/235 |
| 5,240,125 | A | | 8/1993 | Kunz | |
| 5,456,435 | A | * | 10/1995 | Sweeney | 248/250 |
| 5,665,304 | A | * | 9/1997 | Heinen et al. | 312/71 |
| 5,673,801 | A | * | 10/1997 | Markson | 211/59.3 |
| 5,855,283 | A | * | 1/1999 | Johnson | 211/59.3 |
| 6,082,558 | A | * | 7/2000 | Battaglia | 211/59.3 |
| 6,142,317 | A | * | 11/2000 | Merl | 211/59.3 |
| 6,179,136 | B1 | * | 1/2001 | Kluge et al. | 211/90.01 |
| 6,364,136 | B1 | * | 4/2002 | Weshler et al. | 211/90.02 |
| 6,719,152 | B1 | * | 4/2004 | Nagel et al. | 211/59.3 |
| 6,745,906 | B1 | | 6/2004 | Nagel | |
| 6,866,155 | B2 | * | 3/2005 | Nagel | 211/59.3 |
| 6,866,156 | B2 | * | 3/2005 | Nagel et al. | 211/59.3 |
| 6,886,700 | B2 | * | 5/2005 | Nagel | 211/59.3 |
| 6,889,855 | B2 | * | 5/2005 | Nagel | 211/59.3 |
| 7,032,761 | B2 | * | 4/2006 | Nagel | 211/59.3 |
| 7,419,062 | B2 | * | 9/2008 | Mason | 211/59.3 |
| 7,458,473 | B1 | * | 12/2008 | Mason | 211/59.3 |
| 7,681,744 | B2 | * | 3/2010 | Johnson | 211/59.3 |
| 7,690,519 | B2 | * | 4/2010 | Kahl et al. | 211/59.2 |
| 7,854,334 | B2 | * | 12/2010 | Nagel et al. | 211/59.3 |
| 7,918,353 | B1 | | 4/2011 | Luberto | |
| 7,931,156 | B2 | * | 4/2011 | Hardy | 211/59.3 |
| 8,210,367 | B2 | * | 7/2012 | Nagel et al. | 211/88.02 |
| 8,453,851 | B2 | * | 6/2013 | Ciesick | 211/59.3 |
| 2005/0127014 | A1 | | 6/2005 | Richter et al. | |
| 2006/0186065 | A1 | * | 8/2006 | Ciesick | 211/59.3 |
| 2006/0273053 | A1 | * | 12/2006 | Roslof et al. | 211/59.3 |
| 2007/0175839 | A1 | * | 8/2007 | Schneider et al. | 211/59.3 |
| 2010/0025346 | A1 | * | 2/2010 | Crawbuck et al. | 211/59.3 |
| 2010/0108624 | A1 | * | 5/2010 | Sparkowski | 211/59.3 |
| 2010/0176075 | A1 | * | 7/2010 | Nagel et al. | 211/59.3 |
| 2010/0176077 | A1 | * | 7/2010 | Nagel et al. | 211/126.16 |
| 2011/0017684 | A1 | * | 1/2011 | Nagel et al. | 211/59.3 |
| 2011/0210086 | A1 | * | 9/2011 | Ciesick | 211/59.3 |
| 2012/0255924 | A1 | * | 10/2012 | Kologe | 211/126.15 |

* cited by examiner

MERCHANDISE PUSHER TRAY WITH ADJUSTABLE SIDE BARRIERS

CROSS-REFERENCE TO RELATED PATENT APPLICATIONS

This patent application is a Continuation of co-pending U.S. patent application Ser. No. 13/288,058, filed Nov. 3, 2011, the entire teachings and disclosure of which are incorporated herein by reference thereto.

FIELD OF THE INVENTION

This invention generally relates to retail merchandise displays, and more particularly to self-facing retail merchandise displays used for biasing retail merchandise forward.

BACKGROUND OF THE INVENTION

Self-facing retail merchandise displays are generally known in the art. Once such display is the pusher system. A conventional pusher system incorporates one or more pusher paddles or pusher bodies that ride along a respective elongated track. A spring is connected between the pusher body and a leading edge of the track. The spring acts to bias the pusher body forward along the track towards the leading edge thereof A user can retract the pusher body away from the leading edge of the track and position items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

That is, when a customer removes the leading most item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front facing eliminates the necessity for retail store employees to manually face the merchandise, and thus ultimately reduces the cost of labor of the retailer.

The aforementioned pusher systems have been utilized in various retail display environments. One example is a retail shelf. Typically, a plurality of pusher bodies and their corresponding tracks are arranged in a side by side manner along the shelf. Each pusher body and its corresponding track are separated by dividers to maintain a plurality of generally straight rows of merchandise that run from the front to the back of the shelf. Such a familiar configuration can be found in many retail stores for selling hygiene items such as deodorant, as one example.

Unfortunately, there are certain retail environments that have provided great difficulty with regard to the incorporation of a pusher system. Such environments include the commercial refrigerated cabinet or freezer. These displays are typically utilized to carry and display frozen or refrigerated food items on shelving therein. Examples of such items include frozen pizzas, ice cream, etc. The harsh environment inside these displays can cause ice build up which can lead to jamming or mechanical failure of a conventional pusher system if it were incorporated therein.

Further, typical commercial refrigerated cabinets or freezers tend have a significant shelf depth, as well as a significant number of shelves therein. As a result, loading a pusher system situated on this shelving in such a confined area presents significant difficulty and can be quite time consuming. Indeed, to load a pusher system, a user must push the pusher body away from its resting position with one hand, and load merchandise into the pusher system using their other hand. Such a two handed operation compounds in difficulty at greater cabinet depths.

Yet further, typical commercial refrigerated cabinets or freezers incorporate horizontal bars running along a back side thereof. These bars are utilized for shelf mounting and the like. As a result, such shelving extends from these bars in a generally cantilevered extension. This cantilevered extension can cause bending in the shelving when loaded with heavier items. Such bending is particularly problematic for a pusher system given its array of moving components.

Accordingly, there is a need in the art for a pusher system that can be readily incorporated into a refrigerated cabinet or a freezer that can operate in the relatively harsh environment therein, and that can be readily and easily loaded by a retailer.

The invention provides such a system. These and other advantages of the invention, as well as additional inventive features, will be apparent from the description of the invention provided herein.

BRIEF SUMMARY OF THE INVENTION

In one aspect, a merchandise pusher tray is provided. An embodiment of the merchandise pusher tray according to this aspect includes a base structure having a pair of load bearing members arranged in an opposed spaced relationship. The pair of load bearing members each provide a retail merchandise support surface configured for carrying retail merchandise thereon. A pusher is interposed between the pair of load bearing members and moveable relative to the base structure along a first axis. At least one divider is mounted to the base structure and moveable relative to the base structure along a second axis generally perpendicular to the first axis. Each of the load bearing members includes a mount for mounting the base structure as a cantilevered extension from a generally vertical wall.

The base structure can include a floor carried by the pair of load bearing members. The floor defines a retail merchandise support surface configured for carrying retail merchandise thereon. In certain embodiments, the floor is a welded wire assembly including a plurality of longitudinal wires and a plurality of transverse wires joined to each of the plurality of longitudinal wires. In certain embodiments, at least one of the plurality of longitudinal wires includes an upturned end for receiving a front stop.

The at least one divider can include a pair of dividers arranged in an opposed spaced relationship to define a retail merchandise channel. The retail merchandise channel has a variable width based upon an adjusted position of the pair of dividers. In certain embodiments, each of the pair of dividers includes a pair of extensions which extend from a side of each of the pair of dividers and into the base structure. In certain embodiments, the pair of extensions of each of the pair of dividers extends into a front and a rear spacer, respectively. The front and rear spacers are mounted to the base structure between the pair of load bearing members.

The mount of each of each of the pair of load bearing members can have a hook shape and is configured to receive a generally horizontal bar. In certain embodiments, each of the pair of load bearing members includes a support bar and a reinforcement bar. The reinforcement bar is joined to and overlaps the support bar. The mount is formed on each reinforcement bar of each of the pair of load bearing members.

In another aspect, a merchandise pusher tray is provided. An embodiment of a merchandise pusher tray according to this aspect includes a base structure. The base structure includes a pair of load bearing members arranged in an opposed spaced relationship. The pair of load bearing members each has a stiffness region and a support region. The stiffness region is more resistant to deflection under a loading than the support region. This embodiment of the merchandise pusher tray also includes a pusher slideably mounted to the base structure. A pair of moveable dividers are provided. The pair of moveable dividers define a width of a merchandise retaining channel. The width is variable based upon the adjustment of the pair of moveable dividers.

Each of the pair of load bearing members has an overall length. The stiffness region is about four inches to about seven inches of the overall length in one embodiment. In certain embodiments, in the stiffness region, each of the pair of load bearing members has a first cross sectional width. In the support region, each of the pair of load bearing members has a second cross sectional width that is less than the first cross sectional width.

In certain embodiments, each of the pair of load bearing members includes a structural bar and a reinforcement bar. The reinforcement bar overlaps the structural bar to form the stiffness region.

In certain embodiments, the merchandise pusher tray further comprises a retail shelf. The base structure is mounted to a planar top surface of the retail shelf In certain embodiments, the merchandise pusher tray also includes a merchandise bar and a mount. The mount extends from the base structure and receives the merchandise bar.

In yet another aspect, a merchandise pusher tray is provided. An embodiment of a merchandise pusher tray according to this aspect includes a base structure that provides a retail support surface for carrying retain merchandise thereon. A pusher is slideably mounted to the base structure and is slideable along a first axis. A locking arm is also provided. The locking arm is situation between the pusher and the base structure. The locking arm is operable to lock the pusher in a locked position such that the pusher cannot move relative to the base structure along the first axis.

The locking arm can include at least one longitudinal member. The at least one longitudinal member extends from the pusher and is moveable relative to the pusher to engage a portion of the base structure to hold the pusher in the locked position. In certain embodiments, the at least one longitudinal member is operable to engage the base structure when the pusher is in a fully retracted position and the tray is not loaded with retail merchandise.

In certain embodiments, the locking arm further comprises a transverse member and the at least one longitudinal member includes a pair of longitudinal members extending from the transverse member of the locking arm to form a generally U-shaped configuration. The pair of longitudinal members will disengage the base structure upon an actuation force exerted upon the transverse member.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
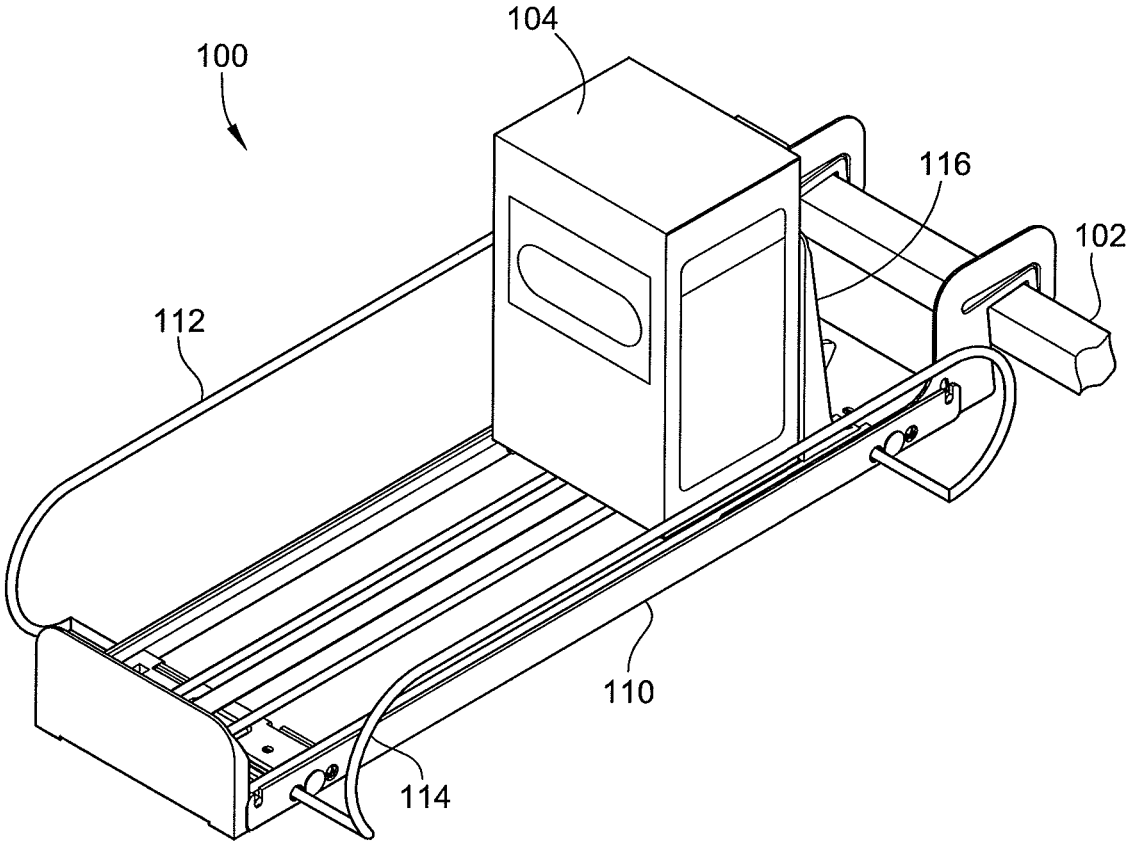
FIG. 1 is a perspective view of an embodiment of a bar mounted merchandise tray with adjustable side barriers according to the teachings of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, an embodiment of a merchandise pusher tray with adjustable side barriers 100 (hereinafter "tray") is illustrated. Tray 100 is illustrated mounted to a retail merchandise display bar 102 typically incorporated in a commercial refrigerator or freezer cabinet. Tray 100 is loaded with retail merchandise 104 and is operable to bias merchandise 104 forward to front face the same. Although illustrated as incorporated in a commercial refrigerator or freezer-type cabinet, it will be readily recognized that the invention is lot limited to this environment alone. Rather, those skilled in the art will recognize from the disclosure herein that the various embodiments of tray 100 can be integrated into other retail displays such as dry goods shelving or the like.

Tray 100 includes a base structure 110. A pair of moveable dividers 112, 114 are mounted to the base structure 110. A pusher 116 is also mounted to base structure 110.

Figure 2:
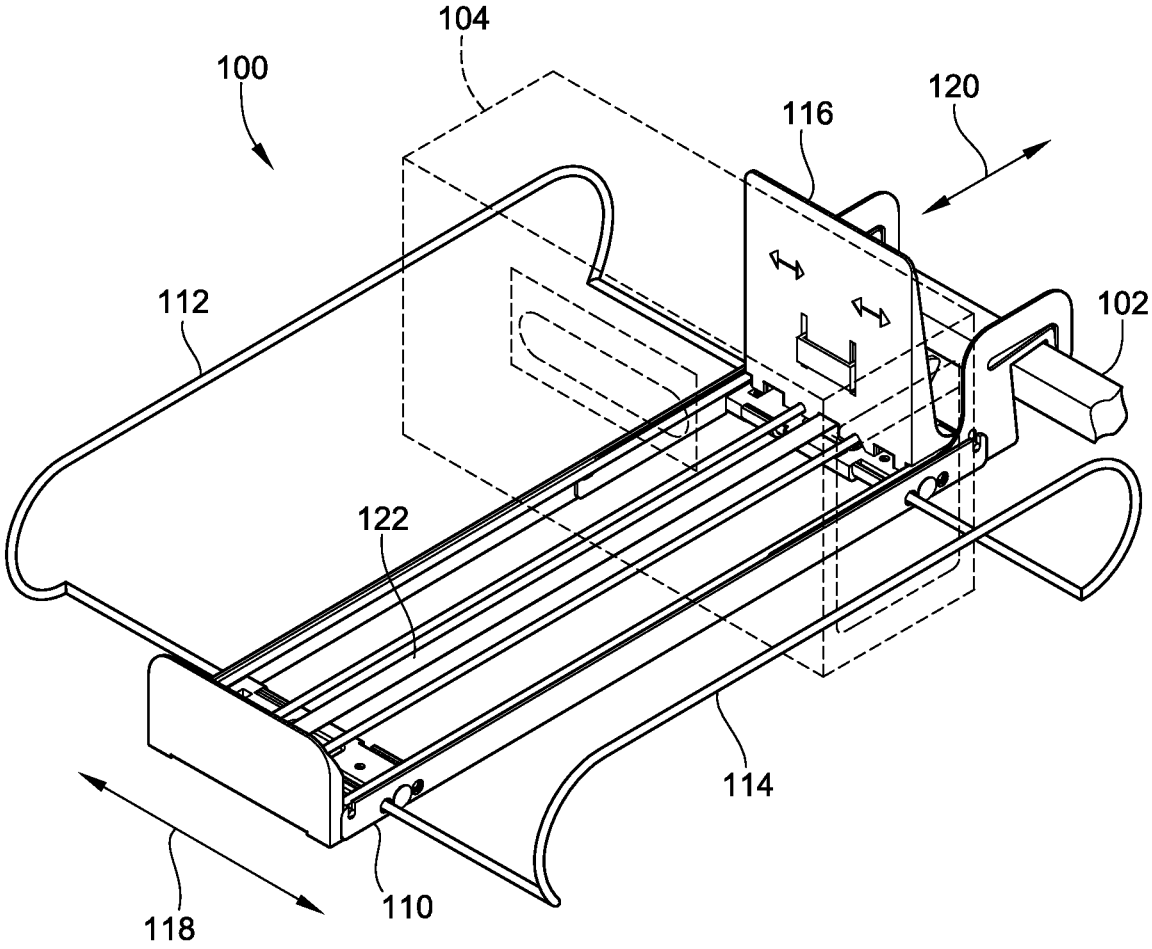
FIG. 2 is a perspective view of the tray of FIG. 1, illustrating the relative motions, respectively, of adjustable side barriers and a pusher assembly of the tray.
Figure 12:
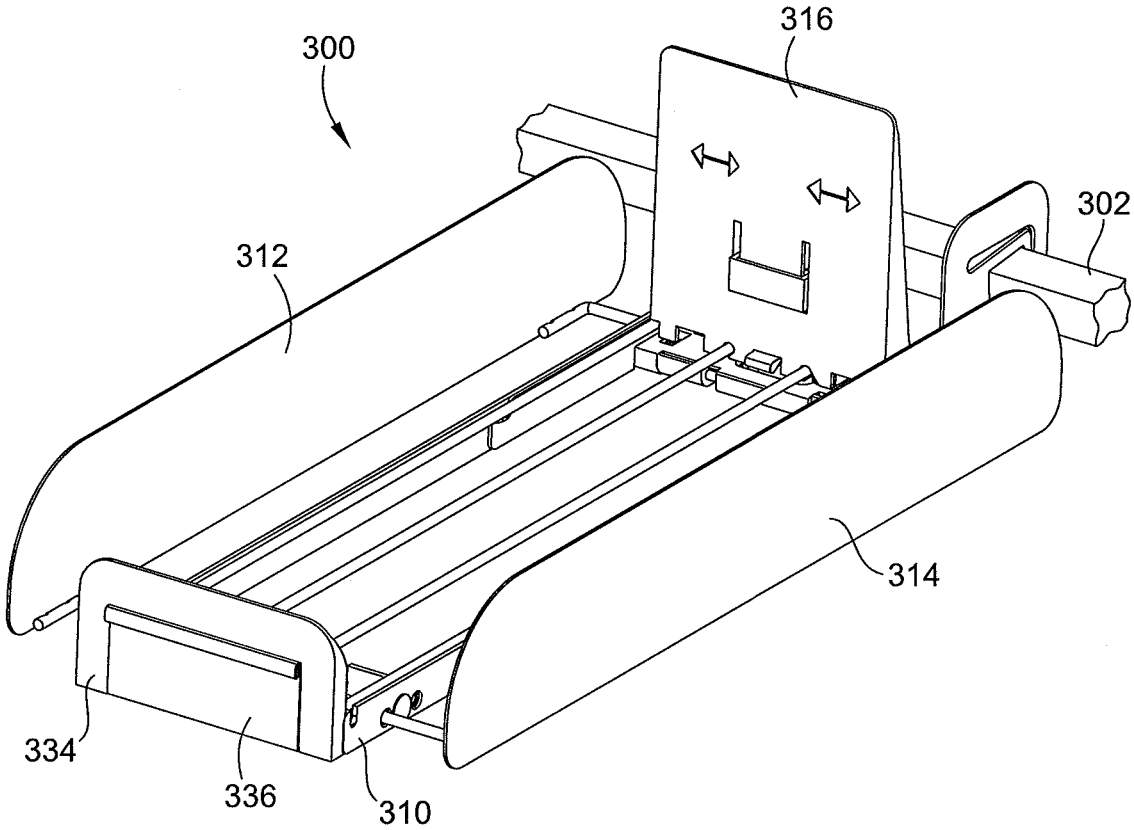
FIG. 12 is a perspective view of a second embodiment of a merchandise pusher tray with adjustable side barriers according to the teachings of the present invention.
Figure 13:
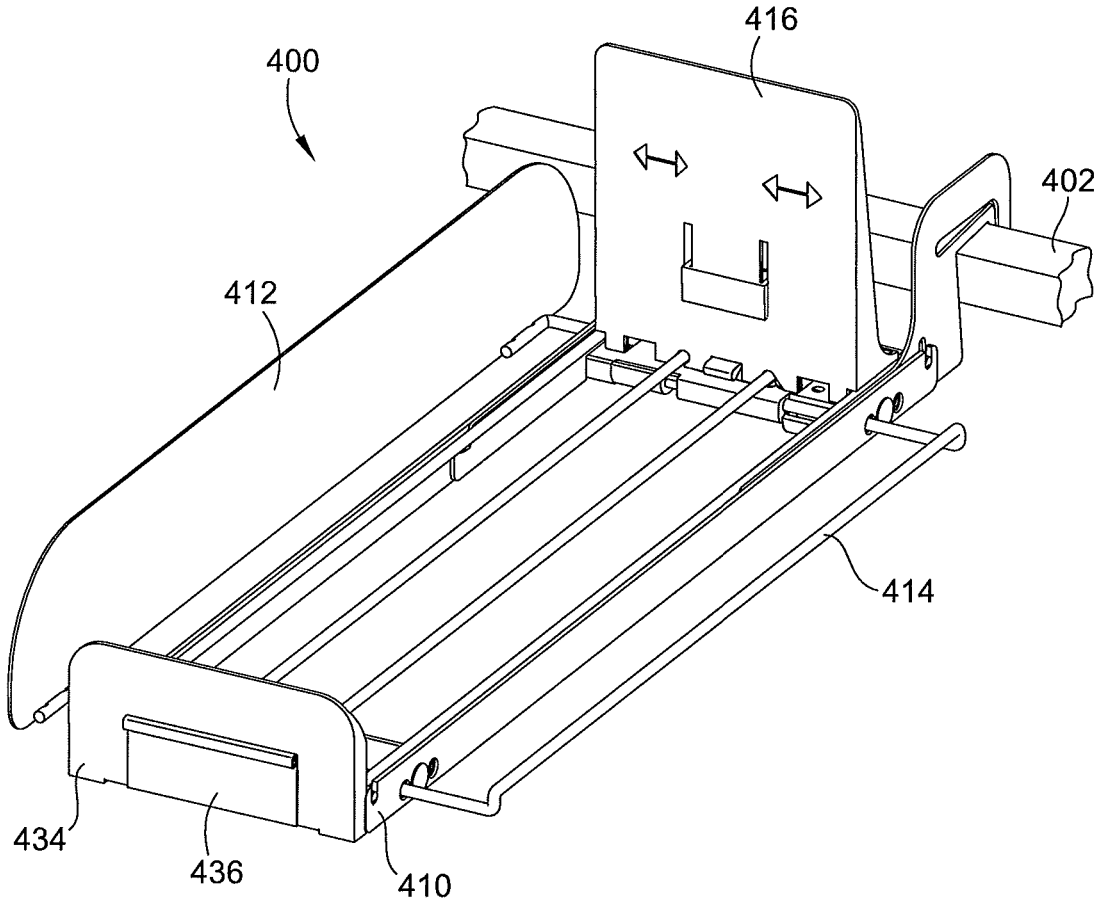
FIG. 13 is a perspective view of a third embodiment of a merchandise pusher tray with adjustable side barriers according to the teachings of the present invention.
Figure 14:
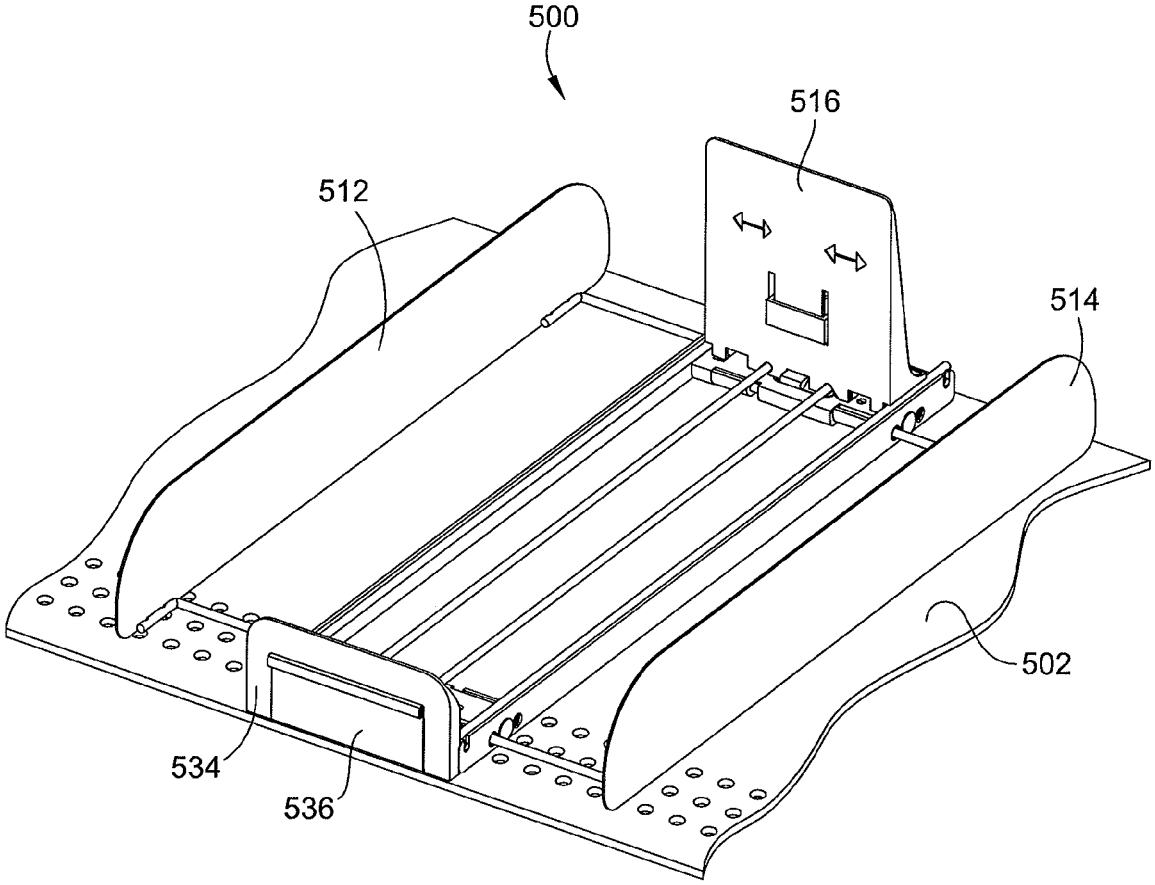
FIG. 14 is a perspective view of a fourth embodiment of a merchandise pusher tray with adjustable side barriers according to the teachings of the present invention.

With reference to FIG. 2, dividers 112, 114 are moveable relative to base structure 110 in direction 118. This adjustability allows a user to define a width of a retail merchandise channel interposed and defined by the dividers 112, 114. As a result, tray 100 is lot limited to a specific width of retail merchandise, and can instead accommodate various widths depending on the particular spacing of dividers 112, 114 set by a user. The dividers 112, 114 may be a wire structure as illustrated, a plate-like structure as shown at FIGS. 12-14, or any other barrier style configuration sufficient to define an area for containing items of retail merchandise.

Pusher 116 is moveable relative to base structure 110 in direction 120. Such movement by pusher 116 accomplishes the front facing of merchandise 104 (See FIG. 1) as described herein. Further, and as will be described in greater detail below, pusher 116 also incorporates an advantageous locking arrangement which is operable to lock pusher 116 in a locked and fully retracted position as illustrated at FIG. 2. This functionality allows a user to lock pusher 116 in the retracted position and thereafter load retail merchandise within the retail merchandise channel defined between dividers 112, 114 without also holding the pusher 116 back against the biasing force provided by spring 122 operably connected to pusher 116.

Figure 3:
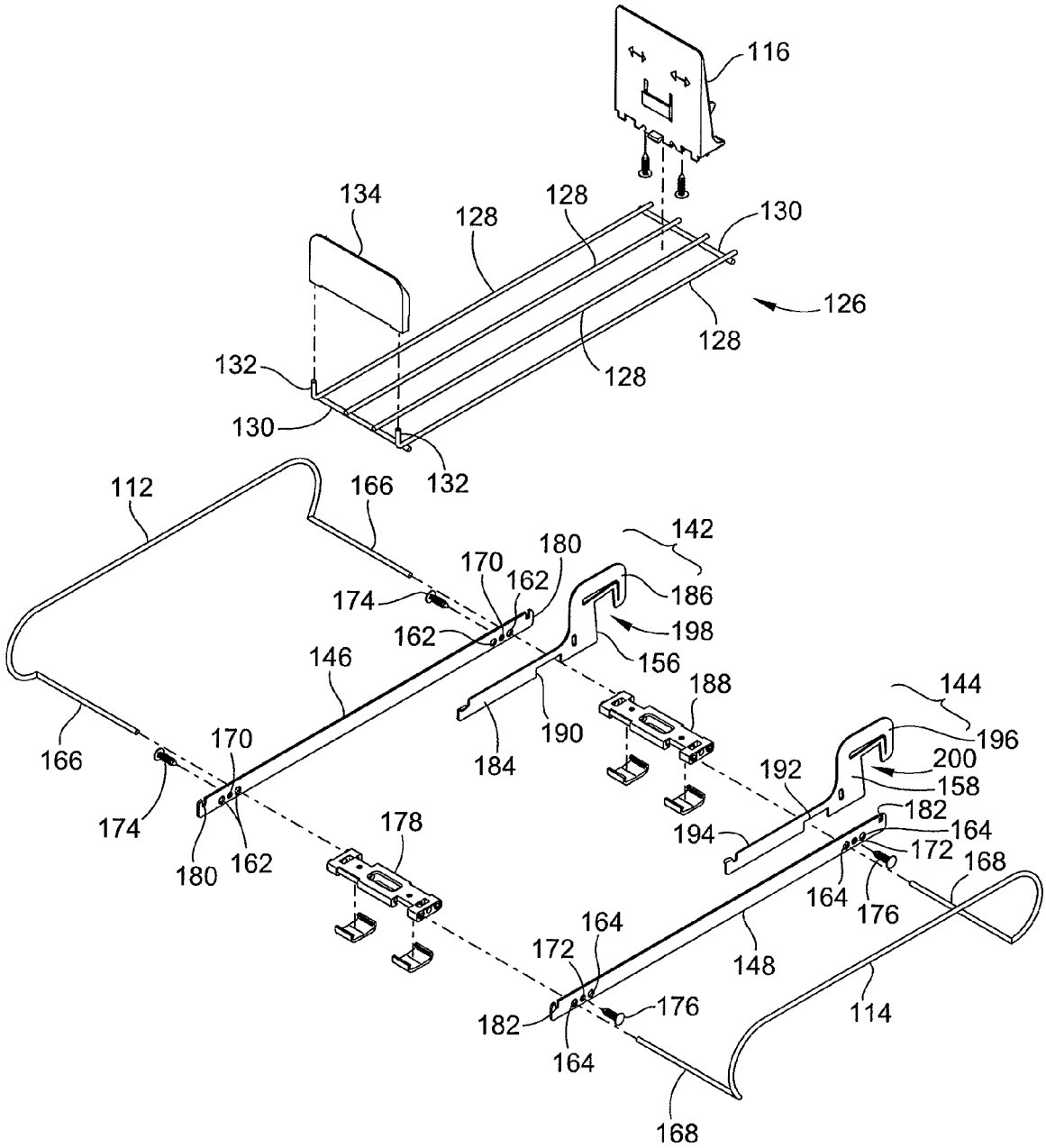
FIG. 3 is an exploded perspective view of the tray of FIG. 1.

Turning now to FIG. 3, with particular attention to base structure 110, the same includes a wire floor 126 which includes a plurality of longitudinal members 128, as well as a plurality of horizontal members 130 welded to the longitudinal members 128. It will be recognized that the particular number of longitudinal members 128 and well as horizontal members 130 illustrated is not limiting, and fewer or more could be used in other embodiments as governed by application. Pusher 116 slidably engages one or more of the longitudinal members 128 of wire floor 126 for movement thereupon.

As shown in FIG. 3, the two outer most longitudinal members 128 include upturned ends 132 for receiving a front stop 134. Front stop 134 defines the front most boundary of the retail merchandise channel at which retail merchandise 104 (See FIG. 1) will abut and be prevented from any further forward travel by front stop 134. Front stop 134 may take on a variety of shapes and sizes, depending upon application, and thus the particular shape/size of front stop 134 is not limiting upon the invention. Further, it will be recognized by those skilled in the art that front stop 134 is interchangeable with other front stops by removing the same from wire frame 126.

Base structure 110 also includes a pair of load bearing members 142, 144. Each load bearing member 142, 144 includes a structural bar 146, 148 and a reinforcing bar 156, 158 arranged in an overlapping fashion. As a result, each load bearing member 142, 144 has a variable cross sectional thickness. In the region of overlap between the structural bars 146, 148 and reinforcement bars 156, 158, each load bearing member 142, 144 will have a first cross sectional thickness. Beyond this region of overlap, each of the load bearing members 142, 144 will have a second cross sectional thickness equal to the thickness of their respective structural bars 146, 148, this second cross sectional thickness being less than the first cross sectional thickness.

Such a configuration provides for an enhanced resistance to deflection under loading due to the cantilevered extension of tray 100, and more particularly load bearing members 140, 142, from merchandise bar 102 (See FIG. 1). It will be recognized by those skilled in the art that such resistance is optimized by the particular size of the region of overlap of each of the load bearing members 142, 144.

Indeed, the region of overlap is a stiffness region wherein load bearing members 142, 144 provide enhanced deflection resistance while simultaneously minimizing the amount of material required to provide such resistance. The remainder of each load bearing member 142, 144 beyond the stiffness region is generally a support region that remains operable to support retail merchandise thereon and provide a sufficient degree of deflection resistance. In one embodiment, the amount of overlap between structural bars 146, 148 and reinforcement bars 156, 158 is about one inch to about ten inches, and preferably about three inches to about eight inches, and even more preferably about four inches to about seven inches.

Each structural bar 146, 148 incorporates apertures 162, 164 for sliding receipt of extensions 166, 168 of dividers 112, 114 respectively. Further, each structural bar 146, 148 also includes apertures 170, 172, respectively, for receipt of pins 174, 176. As will be described in greater detail below, pins 174, 176 are used to fixedly retain spacers 178, 188 between load bearing members 142, 144 to maintain the spacing thereof. Each structural bar 146, 148 also incorporates upwardly opening notches 180, 182, respectively, for receipt of the front and rear horizontal members 130 of wire floor 126. By way of notches 180, 182 the load bearing members 142, 144 support the wire floor 126.

Each reinforcement bar 156, 158 includes a straight portion 184, 194 as well as a mount in the form of a hook portion 186, 196. Each straight portion 184, 194 includes notch 190, 192 to provide clearance for the ends of the rear most spacer 188 such that these ends can abut the structural bar 146, 148 as described below. Each hook portion 186, 196 includes a downwardly opening notch 198, 200 for receipt of the aforementioned merchandise bar 102 (See FIG. 1).

Structural bars 146, 148 are joined to reinforcement bars 156, 158 mechanically by welding or other mechanical means. Such a configuration permits the use of a uniform stock thickness of material to be utilized in manufacturing each of the structural bars 146, 148 and reinforcement bars 156, 158. Further, uniform structural bars 146, 148 may be employed with various combinations of reinforcement bars 156, 158 having differently sized hook portions 186, 198 to accommodate various sizes of merchandise bars 102 (See FIG. 1). Yet further, other mounts may be used instead of hook-style mounts, e.g. slatwall mounts, pegboard mounts, etc.

Figure 4:
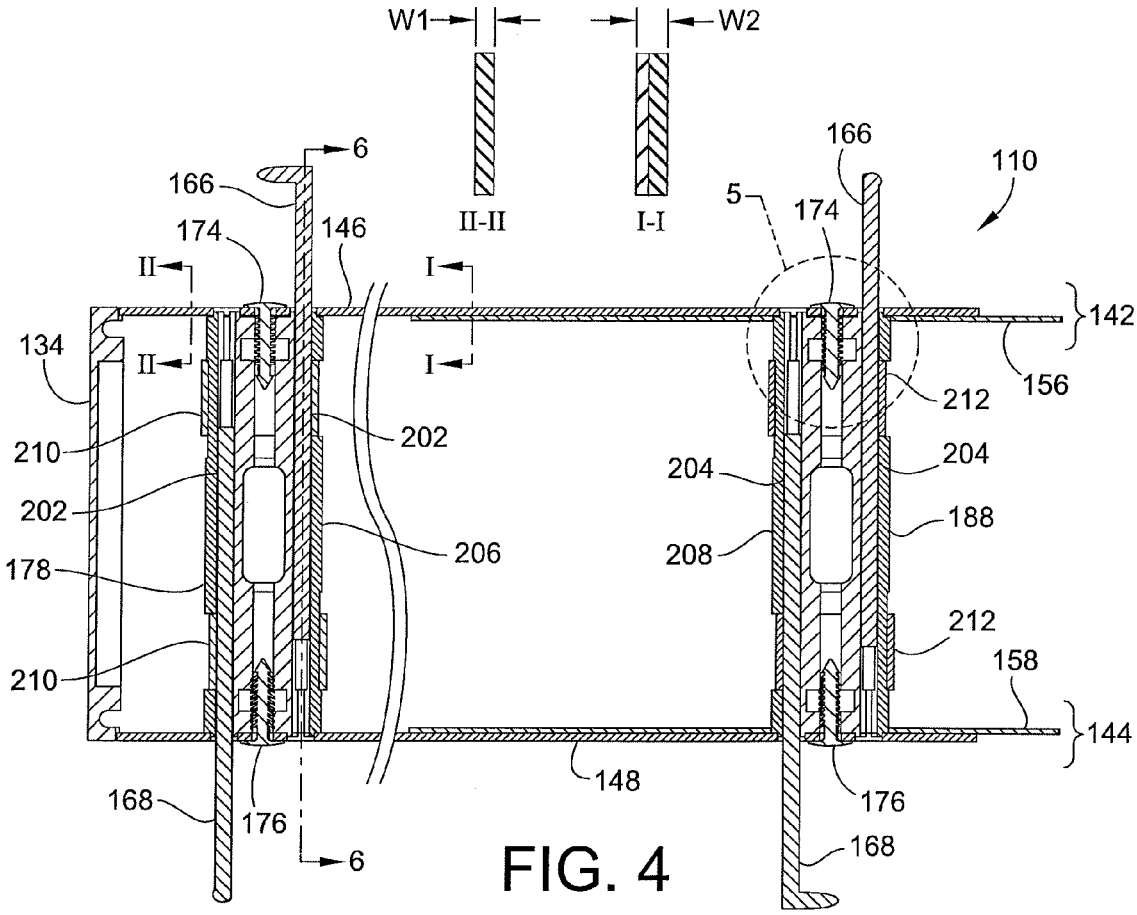
FIG. 4 is a top cross section of the tray of FIG. 1.

Turning now to FIG. 4, a top cross section of the base structure 110 is illustrated. Also illustrated in FIG. 4 is a cross section of the stiffness region (section I-I) having a first cross sectional width W1, as well as the support region having a second cross sectional width W2 at section II-II. Further, the mounted configuration of the spacers 178, 188 is also illustrated. Each spacer 178, 188 receives extensions 166, 168 of each of the respective dividers 112, 114 (See FIG. 3). Each spacer 178, 188 include generally parallel bores 202, 204 respectively. The front most spacer 178 receives extensions 166, 168 in bores 202. Likewise, the rear most spacer 188 receives extensions 166, 168 in bores 204. The bores 202, 204 are formed through a body 206, 208 of each spacer 178, 188.

Further, each spacer 178, 188 incorporates clips 210, 212. Clips 210 are mounted to the front most spacer 178. One clip 210 contacts body 206 at one end of clip 210, while the other end of this clip 210 contacts extension 166. Such contact produces a bearing load against the extension 166 to generally hold the extension 166 in its adjusted position within spacer 178, and more particularly within bore 202. Likewise, the other clip 210 contacts body 206 at one end of the clip 210, while contacting extension 168 at the other end of clip 210. Such contact produces a bearing load against extension 168 to hold it in its adjusted position within bore 202.

For purposes of brevity, it will be recognized that clips 212 mounted to spacer 188 perform in the same manner previously described relative to clips 210. Although illustrated as removable components, clips 210, 212 can also be hingedly connected at one end thereof to the bodies 206, 208 of spacers 178, 188 in another embodiment. In such an embodiment, the clips 210, 212 can rotate about said hinge at one end to contact the extensions 166, 168 at another end of the clips 210, 212 in a similar manner as described above.

Figure 5:
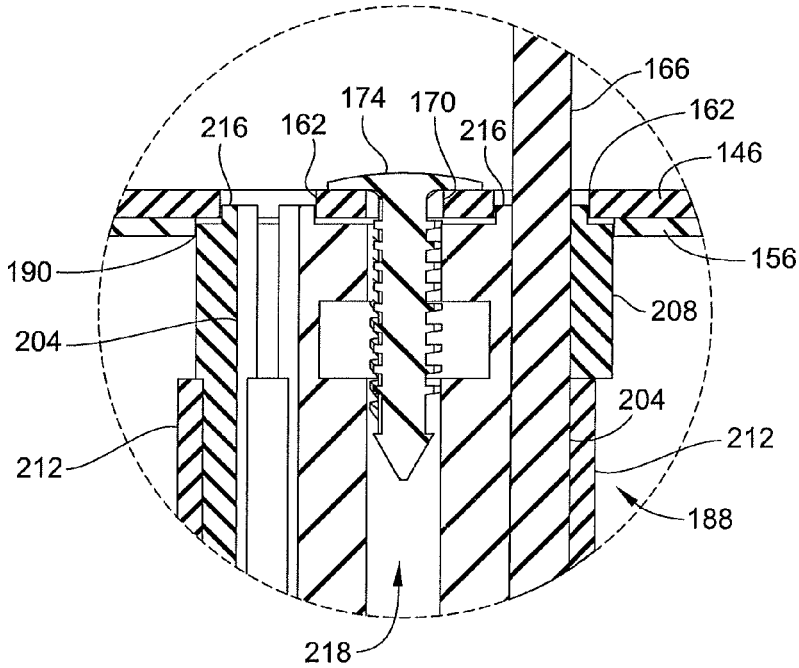
FIG. 5 is a partial view of the cross section of FIG. 4.

Turning now to FIG. 5, the connection of one end of spacer 188 to load bearing member 142 is illustrated. It will be recognized by those skilled in the art that the other end of spacer 188 is connected to load bearing member 144 in the same manner. Further, the ends of spacer 178 are connected to load bearing members 142, 144 in the same manner as well. As shown at FIG. 5, the end of spacer 188 extends through notch 190 formed in reinforcement bar 156. Flanges 216 extending from the ends of bores 204 extend into apertures 162 of the structural bar 146. Flanges 216 thus quickly align spacer 188 relative to apertures 162 of load bearing member 142 and also quickly align bore 218 which extends through body 208 and receives pin 174. It will be recognized by those skilled in the art that pin 174 may be omitted and spacer 188 will be held in place by the interconnection of flanges 216 within apertures 162.

Figure 6:
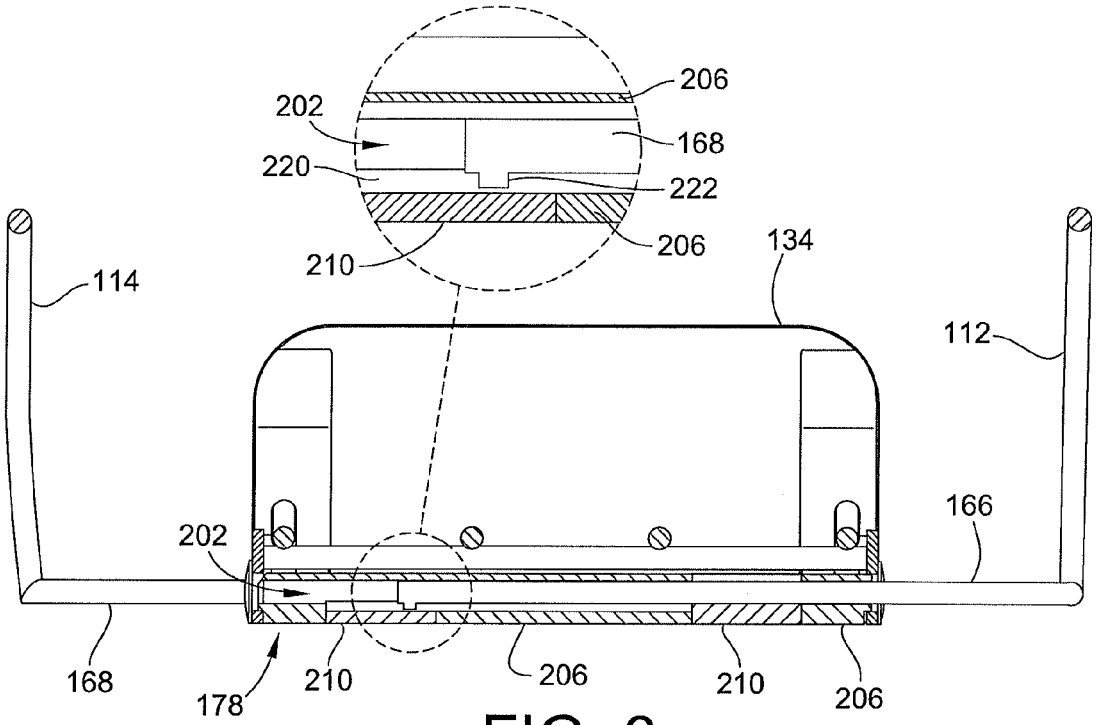
FIG. 6 is a front cross section of the tray of FIG. 1.

Turning now to FIG. 6, a cross-section of bore 202 extending through spacer 178 is illustrated. As illustrated, bore 202 includes a keyway 220. The keyway 220 allows for passage of a key 222 formed at an end of extension 168. Further the left most clip 210 in FIG. 6 also includes a keyway aligned with keyway 220. It will be recognized, however, that the right most clip 210 does not incorporate such a keyway. As a result, key 222 will abut the edge of clip 210 and prevent further movement from left to right of divider 112 as shown in FIG. 6. Such a configuration limits or prevents the divider 112 from being entirely removed from bore 202. Although not shown, a similar configuration is provided in the other bore 202 of spacer 178 to prevent the removal of divider 114. Additionally, spacer 188 incorporates a like configuration such that the dividers 112, 114 are limited to a maximum width position and are not readily removable from the remainder of tray 100.

Figure 7:
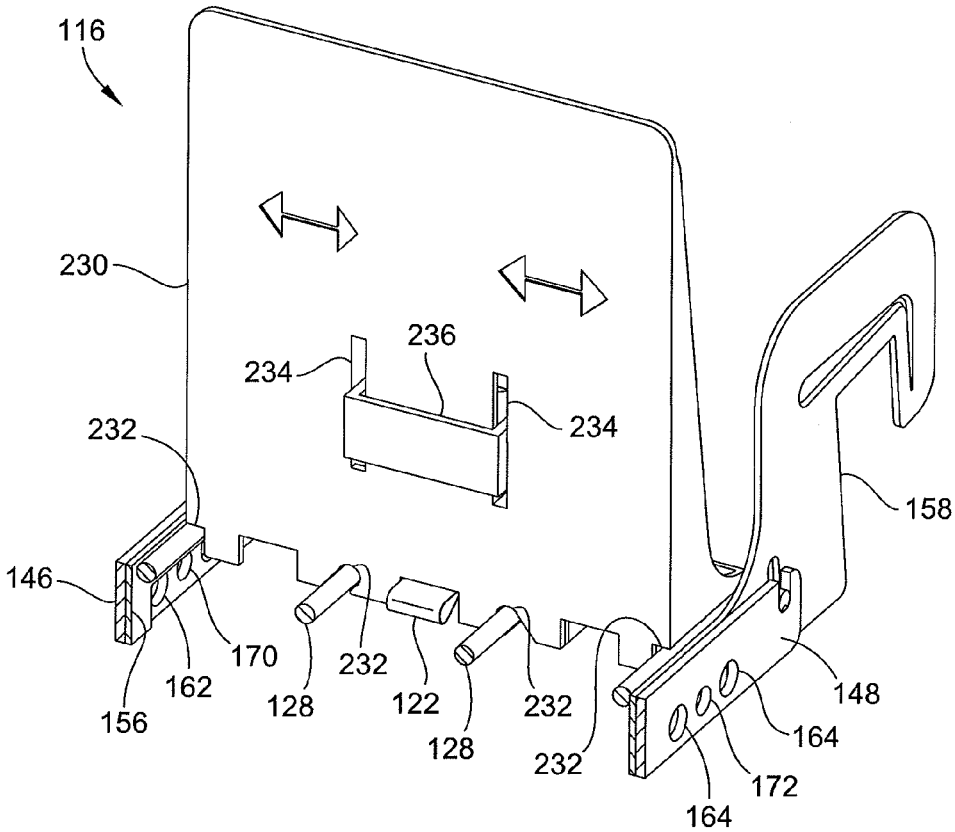
FIG. 7 is a rear cross section of the tray of FIG. 1.

Turning to FIG. 7, the particulars of the pusher 116 will be discussed in greater detail. The pusher 116 includes a pusher body 230 that is a generally upright paddle as illustrated. At a bottom edge of the pusher body 230, there is disposed a plurality of notches 232 that receive longitudinal members 128. The pusher body 230 is slidable along longitudinal members 128 at notches 232. As illustrated, the inner most notches 232 are generally curved, while the outer most notches 232 are generally a right angle cut-out. Pusher body 230 also incorporates a pair of slots 234 therethrough for receipt of a locking arm 236 which will be described in greater detail below. Pusher body 116 also carries spring 122 introduced above at FIG. 2. Those skilled in the art will recognize that pusher body 116 is interchangeable with other sizes of pusher bodies to accommodate differing sizes of retail merchandise.

Figure 8:
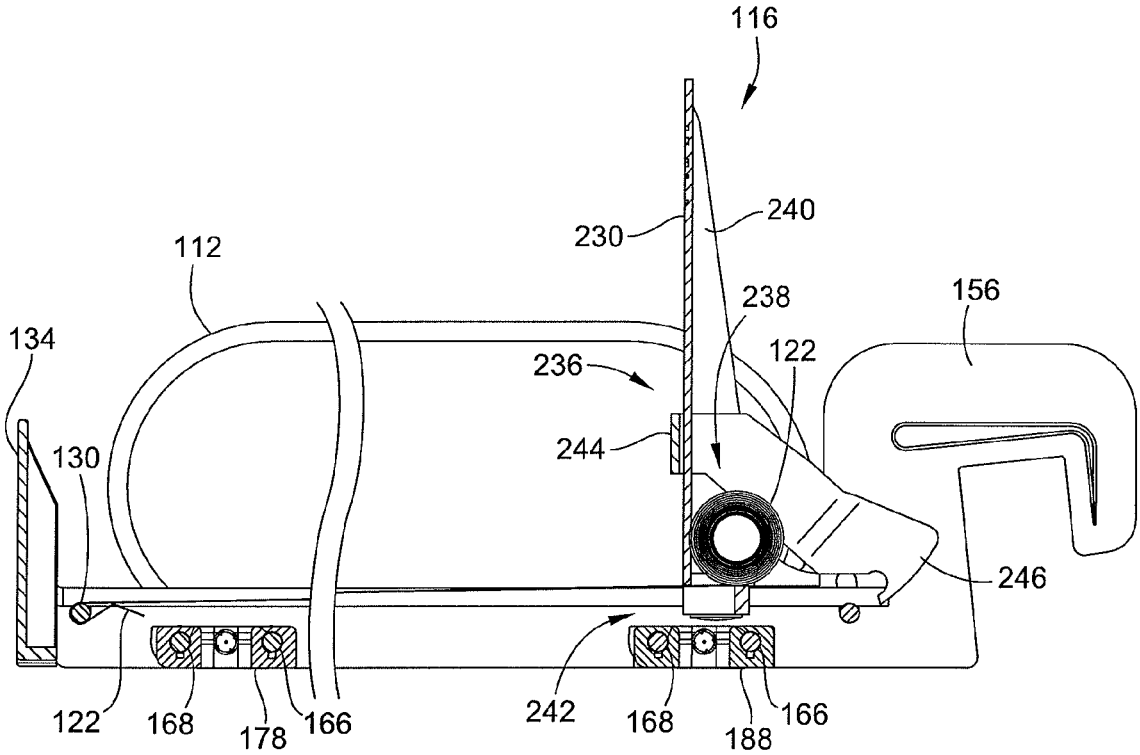
FIG. 8 is a side cross section of the tray of FIG. 1.

More particularly, and with reference now to FIG. 8, spring 122 is carried within an internal cavity 238 of the pusher body 230. The internal cavity 238 is bounded and defined by generally vertical support walls 240 (See also FIG. 9) which support the pusher body 230. As illustrated at FIG. 8, spring 122 is generally a coil spring that extends from internal cavity 238 through opening 242 formed in pusher body 230. A terminal end of spring 122 is fixedly connected to the front most horizontal member 130 of wire floor 126 (See FIG. 3). Alternatively, spring 122 could be attached elsewhere, such as to front stop 134 in other embodiments.

Figure 9:
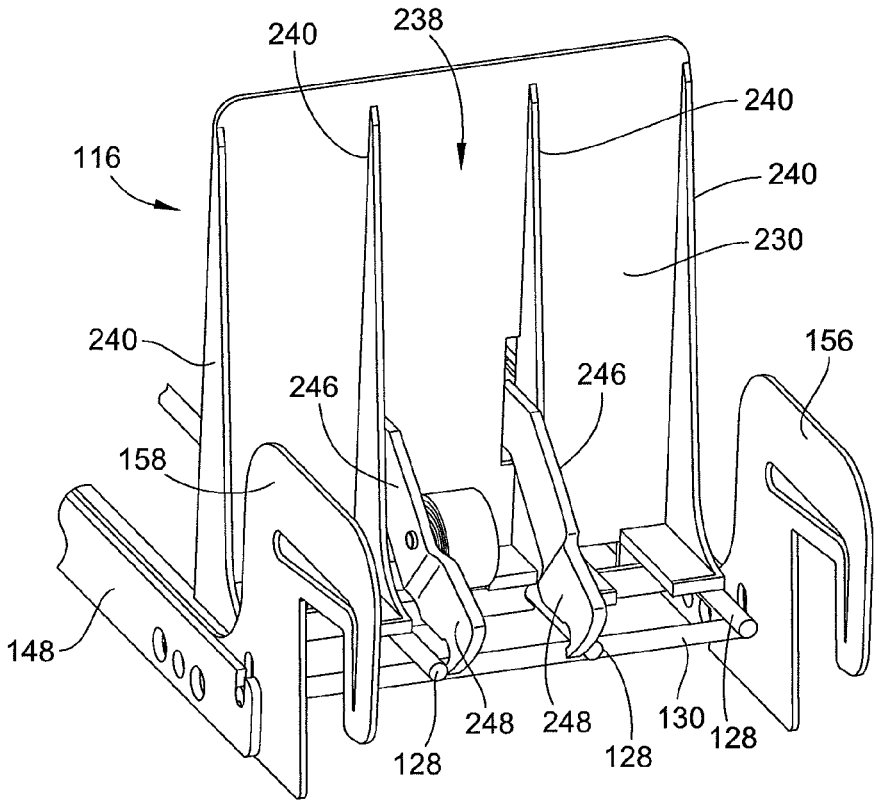
FIG. 9 is a partial top perspective view of the tray of FIG. 1.

Turning now to FIG. 9, the locking arm 236 include a transverse member 244 and a pair of longitudinal members 246. Each of the longitudinal members 246 include a hook portion 248 at an end thereof. The hook portion 248 incorporates a notch 250 for selective receipt of the rear most horizontal member 130.

Figure 10:
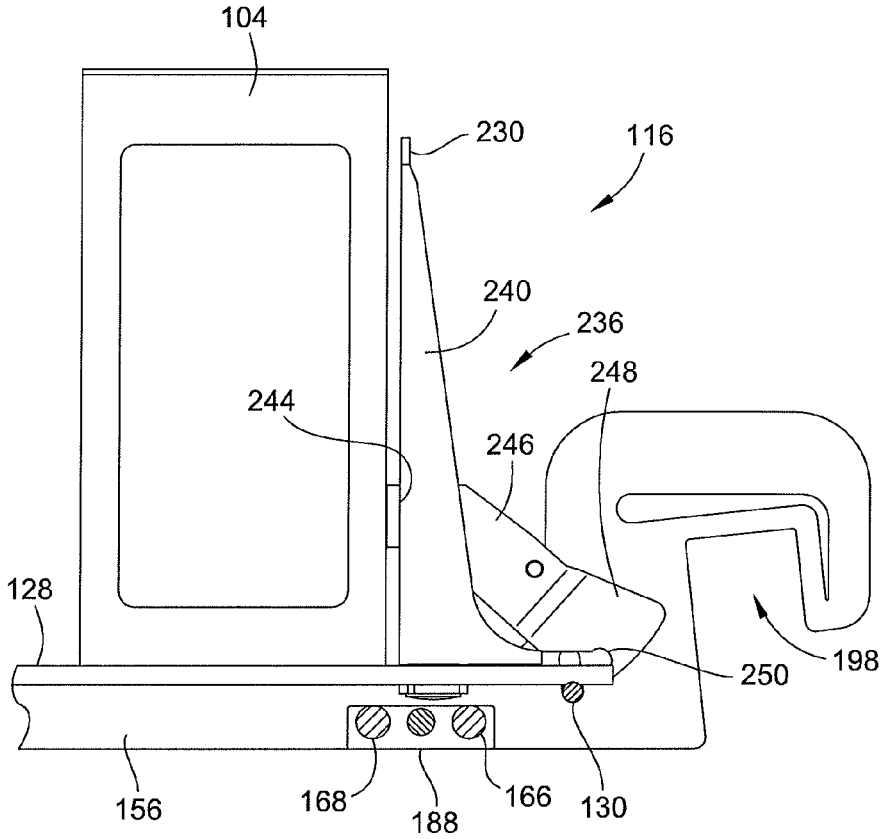
FIG. 10 is a partial side cross section of the pusher assembly of the tray of FIG. 1 in an unlocked configuration.

More specifically, and with reference now to FIG. 10, a portion of the tray 100 is illustrated with retail merchandise 104 carried therein. As illustrated, merchandise 104 is positioned against the transverse member 244 of the locking arm 236 such that the transverse member 244 is generally parallel to the vertically extending front face of the pusher body 230. As a result, notch 250 remains out of contact with the rear most horizontal member 130 of the wire frame 126 (See also FIG. 3).

Figure 11:
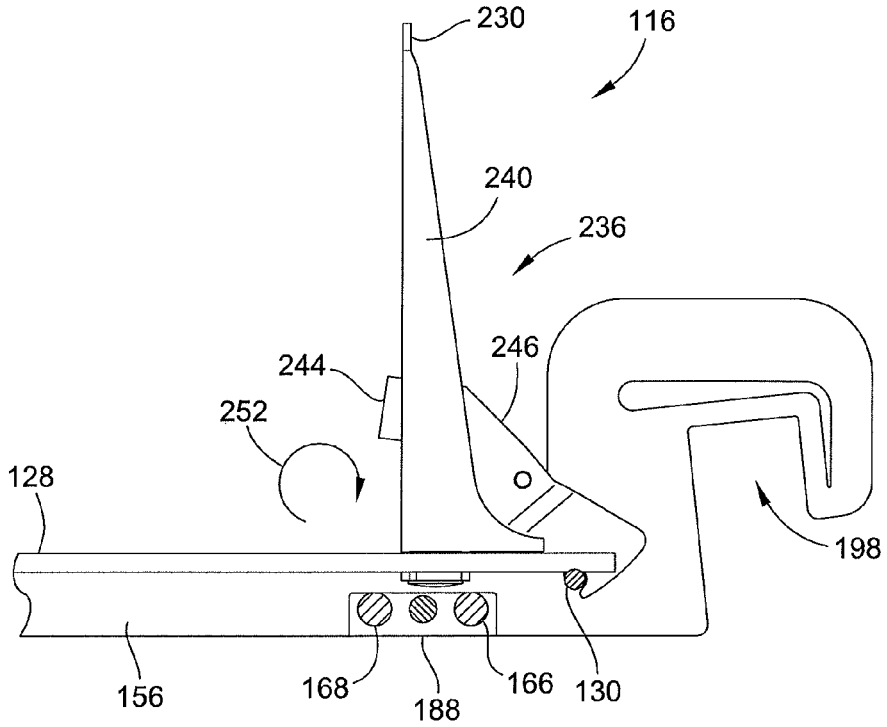
FIG. 11 is a partial side cross section of the pusher assembly of the tray of FIG. 1 in a locked configuration.

However, and referring now to FIG. 11, when tray 100 is unloaded and pusher 116 is at its refracted position, locking arm 236 will rotate in direction 252 as illustrated such that notches 250 of the longitudinal members 246 of the locking arm 236 engage the rear most horizontal member 130 of wire frame 126. Such rotation in direction 252 occurs as a result of the cantilevered extension of longitudinal members 246 out of slots 234 formed in pusher body 230.

Such a configuration allows a user to lock the pusher 116 in place when it is not loaded with merchandise 104 (See FIG. 10). This configuration advantageously allows a user to load tray 100 using two hands, as opposed to holding the pusher 116 in its refracted or rear most position while using another single hand to load tray 100. Put differently, locking arm 236 allows for the two-handed manipulation and loading of merchandise into tray 100. It will be recognized by those skilled in the art that this advantageously overcomes existing designs wherein it is required to hold a pusher with one hand and load merchandise with only a single hand.

Turning now to FIG. 12, another embodiment of a tray 300 is illustrated. This embodiment is generally similar to the embodiment described above with the exception that the tray 300 incorporates solid side dividers 312, 314, as opposed to the wire-type dividers 112, 114 (See FIG. 3) described above. This embodiment of tray 300 also contemplates bar mounting to a merchandise bar 302. Further, this embodiment also incorporates a pusher 316 as described above. Dividers 312, 314 and pusher 316 are mounted to the base structure 310 and are moveable relative thereto in the same manner as described above. Additionally, this embodiment also incorporates an integrated label holder 336 mounted to front stop 334 of tray 300. Integrated label holder 336 is mounted to front stop 334 in such a way that the bottom surface of integrated label holder 336 is flush with a bottom surface of front stop 334. Integrated label holder 336 may also be incorporated with all other embodiments disclosed herein.

Turning now to FIG. 13, another embodiment of a tray 400 is illustrated. This embodiment also is mounted to a retail merchandise bar 402. This embodiment also incorporates a pusher 416 moveable relative to a base structure 410 of the illustrated embodiment. Additionally, tray 400 incorporates moveable dividers 412, 414 that function in the same manner as described above. However, it will be recognized from inspection of FIG. 13 that only one of dividers 412, 410, particularly divider 412, includes a plate-like side member.

As illustrated, the other divider 414 is simply a wire. Such an embodiment is particularly advantageous for functioning as an end tray of a row of trays mounted to bar 402. Indeed, this illustrated embodiment presents a left most tray 400 of a row of trays mounted to bar 402. In an embodiment not illustrated, the plate-like divider is reversed such that divider 414 contains an upright plate-like member while divider 412 is simply a wire. Such an embodiment would function as a right most tray of a plurality of trays mounted to bar 402.

Finally, turning now to FIG. 14, yet another embodiment of a tray 500 is illustrated. This embodiment incorporates a moveable pusher 516 as well as moveable dividers 512, 514. Unlike the previous embodiments, however, this embodiment of tray 500 is mounted to a conventional retail shelf 502, and thus does not incorporate any cantilever-type mounting. This embodiment also incorporates a front stop 534 with an integrated label holder 536 as described above.

Although not illustrated, all of the aforementioned embodiments can omit the movable dividers 112, 114, 312, 314, 412, 414 entirely and still achieve the various advantages described herein. Further, the embodiments shown at FIGS.

12-14 incorporate all of the features of the embodiment described at FIGS. 1-11, with the exception of the differences identified in the preceeding.

As described herein, embodiments of the present invention provide a new and improved solution to existing pusher systems given that the invention may be readily incorporated in a commercial refrigerated or freezer-type display. Further, embodiments of the present invention provide for enhanced load bearing capabilities to counteract the otherwise bending loads exerted upon typical cantilever mounted retail support structures mounted in such environments. Finally, embodiments of the present invention provide a new and improved locking arrangement to lock a pusher in place so that a user may employ both hands while loading a merchandise pusher tray incorporating such a locking arrangement.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A merchandise pusher tray, comprising:

a base structure including a pair of load bearing members each having a major longitudinal length and arranged in an opposed spaced relationship and a wire support frame carried by the load bearing members, wherein the load bearing members are positioned adjacent opposed sides of the wire support frame, respectively;

a pusher interposed between the pair of load bearing members and movable relative to the base structure along a first axis;

at least one divider mounted to the base structure and movable relative to the base structure along a second axis generally perpendicular to the first axis; and wherein each of the load bearing members includes a mount for mounting the base structure as a cantilevered extension from a generally vertical wall and includes a variable cross sectional width perpendicular to its major longitudinal length.

2. The tray of claim 1, wherein the base structure defines a retail merchandise support surface for carrying retail merchandise directly thereon.

3. The tray of claim 1, wherein the wire support frame includes a plurality of longitudinal wires and a plurality of transverse wires joined to each of the plurality of longitudinal wires.

4. The tray of claim 3, wherein at least one of the plurality of longitudinal wires includes an up-turned end for receiving a front stop.

5. The tray of claim 1, wherein the at least one divider includes a pair of dividers arranged in an opposed spaced relationship to define a retail merchandise channel, the retail merchandise channel having a variable width based upon an adjusted position of the pair of dividers.

6. The tray of claim 5, wherein each of the pair of dividers includes a pair of extensions which extend from a side of each of the pair of dividers and into the base structure.

7. The tray of claim 6, wherein the pair of extensions of each of the pair of dividers extends into a front and a rear spacer, respectively, the front and rear spacers mounted to the base structure between the pair of load bearing members and beneath the wire support frame.

8. The tray of claim 1, wherein the mount of each of the pair of load bearing members is hook shaped and is configured to receive a generally horizontal bar.

9. The tray of claim 8, wherein each of the pair of load bearing members includes a support bar and a reinforcement bar, the reinforcement bar joined to and overlapping the support bar, and wherein the mount is formed on each reinforcement bar of each of the pair of load bearing members.

10. A merchandise pusher tray, comprising:

a base structure including a pair of load bearing members, the pair of load bearing members each having an interior side and an exterior side, the interior sides of the pair of load bearing members facing one another and the exterior sides facing away from one another, with the pair of load bearing members arranged in an opposed spaced relationship, the pair of load bearing members each having a stiffness region and a support region, the stiffness region being more resistant to deflection under a loading than the support region;

a pusher slidably mounted to the base structure; and a pair of movable dividers, the pair of movable dividers defining a width of a merchandise retaining channel, the width variable based upon adjustment of the pair of movable dividers; and wherein the stiffness region of each one of the pair of load bearing members has a first width measured between the interior and exterior side within the stiffness region of said one load bearing member, and wherein the support region of each one of the load bearing members has a second width measured between the interior and exterior side within the support region of said one load bearing member, the second width being less than the first width.

11. The tray of claim 10, wherein each of the pair of load bearing members has an overall length, and wherein the stiffness region is about 4 inches to about 7 inches of the overall length.

12. The tray of claim 10, wherein in the stiffness region, each of the pair of load bearing members has a first cross sectional width, and in the support region, each of the pair of load bearing members has a second cross sectional width that is less than the first cross sectional width.

13. The tray of claim 12, wherein each of the pair of load bearing members includes a structural bar and a reinforcement bar, the reinforcement bar overlapping the structural bar to form the stiffness region.

14. The tray of claim 10, further comprising a merchandise bar and mount, the mount extending from the base structure and receiving the merchandise bar.

* * * * *